US009574334B2

(12) United States Patent
Gormley et al.

(10) Patent No.: US 9,574,334 B2
(45) Date of Patent: Feb. 21, 2017

(54) STATIONARY CUTTER RING FOR WASTE DISPOSALS

(71) Applicant: General Electric Company, Schenectady, NY (US)

(72) Inventors: Joseph Emil Gormley, Louisville, KY (US); Raymond James VanAssche, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 341 days.

(21) Appl. No.: 14/322,238

(22) Filed: Jul. 2, 2014

(65) Prior Publication Data

US 2016/0002900 A1 Jan. 7, 2016

(51) Int. Cl.

| | |
|---|---|
| ***B02C 23/36*** | (2006.01) |
| ***E03C 1/266*** | (2006.01) |
| ***B02C 18/06*** | (2006.01) |
| ***B02C 18/00*** | (2006.01) |

(52) U.S. Cl.

CPC ..... *E03C 1/2665* (2013.01); *B02C 18/0092* (2013.01); *B02C 18/062* (2013.01); *B02C 23/36* (2013.01)

(58) Field of Classification Search

CPC .... E03C 1/2665; B02C 23/36; B02C 18/0092; B02C 18/062

USPC ..... 241/46.01–46.017

See application file for complete search history.

(56) References Cited

U.S. PATENT DOCUMENTS

| | | | | |
|---|---|---|---|---|
| 2,938,558 | A * | 5/1960 | Urschel | B02C 18/062 241/86.1 |
| 6,000,840 | A * | 12/1999 | Paterson | B01F 7/164 241/46.11 |
| 8,146,843 | B2 | 4/2012 | Ye et al. | |
| 2010/0012757 | A1* | 1/2010 | Ye | E03C 1/2665 241/46.013 |

FOREIGN PATENT DOCUMENTS

| | | |
|---|---|---|
| CN | 202290224 U | 7/2012 |
| CN | 203155333 U | 8/2013 |

* cited by examiner

*Primary Examiner* — Mark Rosenbaum
(74) *Attorney, Agent, or Firm* — Dority & Manning, P.A.

(57) ABSTRACT

In one aspect, a cutter system for a waste disposal may generally include a cutter ring having an upper surface and a lower surface. In addition, the cutter ring may define a plurality of cutter slots. Each cutter slot may extend between a top end and a bottom end and may be defined by a first curved sidewall and a second curved sidewall. The first and second curved sidewalls may extend between the top and bottom ends such that each cutter slot defines a curved profile extending axially and circumferentially between the upper and lower surfaces of the cutter ring.

20 Claims, 5 Drawing Sheets

STATIONARY CUTTER RING FOR WASTE DISPOSALS

FIELD OF THE INVENTION

The present subject matter related generally to waste disposal systems for processing waste and, more particularly, to an improved stationary cutter ring for use within a waste disposal.

BACKGROUND OF THE INVENTION

Waste disposal units are typically used to process solid waste, such as food waste, garbage and/or other waste, into particulates small enough to pass through associated drain plumbing. A conventional waste disposal is configured to be mounted onto a sink drain extending downward from a corresponding sink such that water/waste discharged from the sink may be directed into the disposal. The water/waste is typically directed into a grind chamber defined above a cutting or grinding mechanism of the disposal. The grinding mechanism is coupled to a shaft of a corresponding motor to allow the grinding mechanism to be rotated at high speeds. The waste contained within the grind chamber is typically ground, shredded, cut and/or otherwise processed into small particulates as a result of the rotation of the grinding mechanism relative to a stationary cutter ring extending around the outer perimeter of the grinding mechanism. The water and processed waste may then be discharged from the disposal and transmitted through the associated plumbing.

Conventional cutter rings typically include a plurality of openings or slots defined therein to facilitate processing of the waste contained within the grind chamber, with each slot extending axially or perpendicularly from a bottom surface or edge of the cutter ring. Unfortunately, it has been found that such axially extending slots typically require a significantly large cutting force in order to process the waste and prevent jamming of the disposal. Moreover, in order to reduce the required cutting force, the circumferential width of such slots must be rather large. As a result, the number of slots that may be defined around the circumference of the cutter ring is reduced, thereby reducing the overall efficiency and performance of the disposal.

Accordingly, an improved cutter ring configuration for a waste disposal that provides for reduced loading on the rotatable cutting or grinding mechanism and/or that provides for increased cutting or grinding performance and/or efficiency would be welcomed in the technology.

BRIEF DESCRIPTION OF THE INVENTION

Aspects and advantages of the invention will be set forth in part in the following description, or may be obvious from the description, or may be learned through practice of the invention.

In one aspect, the present subject matter is directed to a cutter system for a waste disposal. The cutter system may generally include a cutter ring having an upper surface and a lower surface. In addition, the cutter ring may define a plurality of cutter slots. Each cutter slot may extend between a top end and a bottom end and may be defined by a first curved sidewall and a second curved sidewall. The first and second curved sidewalls may extend between the top and bottom ends such that each cutter slot defines a curved profile extending axially and circumferentially between the upper and lower surfaces of the cutter ring.

In another aspect, the present subject matter is directed to a cutter system for a waste disposal. The cutter system may generally include a cutter ring having an upper surface and a lower surface. In addition, the cutter ring may define a plurality of cutter slots. Each cutter slot may extend between a top end and a bottom end and may be defined by first and second sidewalls extending between the top and bottom ends. The first sidewall may define a first inner edge and the second sidewall may define a second inner edge, wherein the first inner edge is staggered radially relative to the second inner edge along at least a portion of an axial height defined between the top and bottom ends.

In a further aspect, the present subject matter is directed to a waste disposal including a housing, a motor disposed within the housing and a cutter system disposed within the housing. The cutter system may generally include a cutter plate rotatably coupled to the motor. The cutter plate may include a cutter lug positioned adjacent to an outer perimeter of the cutter plate. The cutter system may also include a cutter ring extending around the outer perimeter of the cutter plate. The cutter ring may include an upper surface and a lower surface. In addition, the cutter ring may define a plurality of cutter slots. Each cutter slot may extend between a top end and a bottom end and may be defined by a first curved sidewall and a second curved sidewall. The first and second curved sidewalls may extend between the top and bottom ends such that each cutter slot defines a curved profile extending axially and circumferentially between the upper and lower surfaces of the cutter ring.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which.

DETAILED DESCRIPTION OF THE INVENTION

Figure 1:
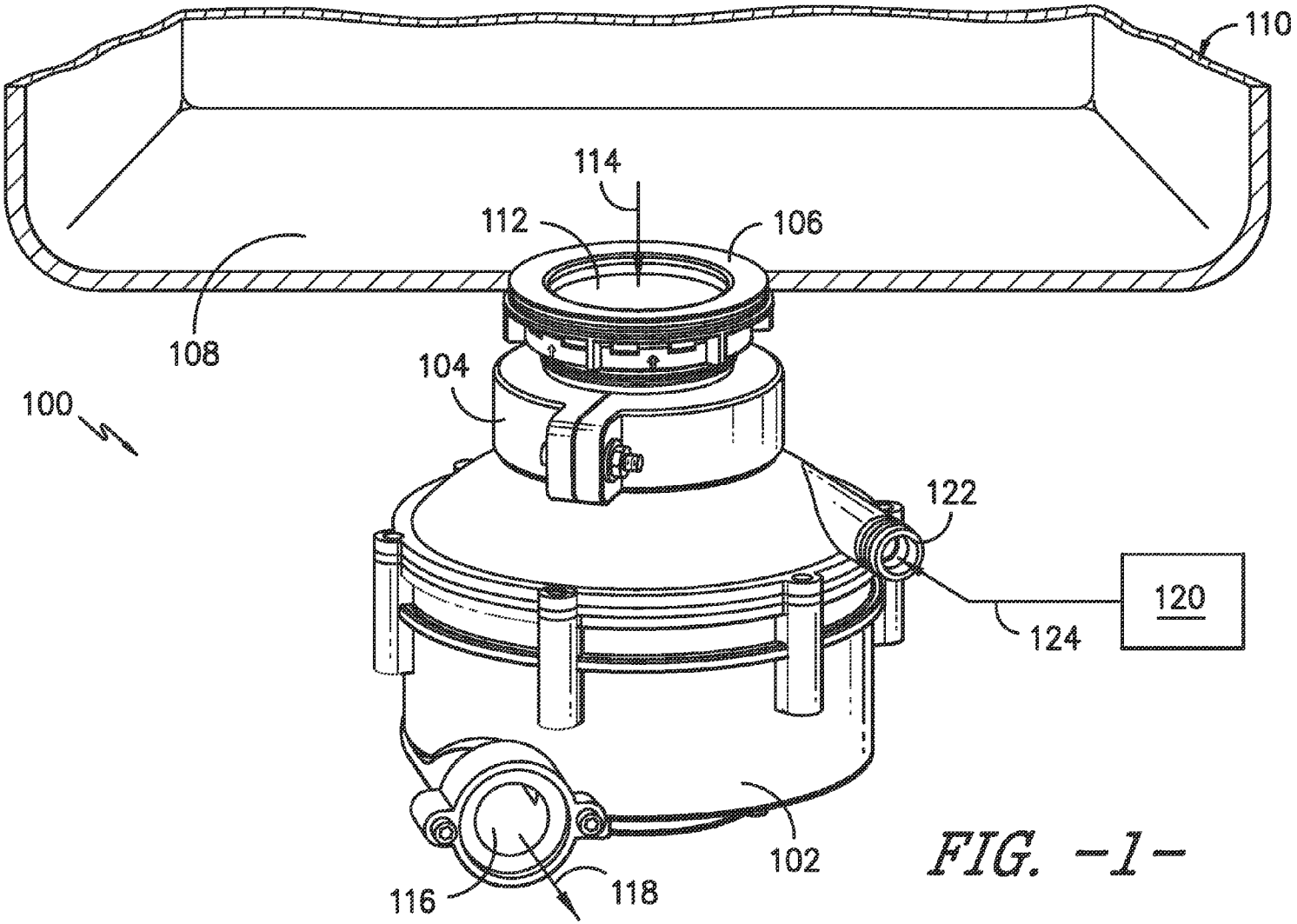
FIG. 1 illustrates a perspective view of one embodiment of a waste disposal system in accordance with aspects of the present subject matter, particularly illustrating a waste disposal of the system mounted onto a sink drain of a corresponding sink via a mounting assembly.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Referring now to the drawings, FIG. 1 illustrates a perspective view of one embodiment of a waste disposal system 100 in accordance with aspects of the present subject matter. As shown, the waste disposal system 100 generally includes a waste disposal 102 and a mounting assembly 104 configured for mounting the disposal 102 to a sink drain 106 extending from the bottom of a sink basin 108 of a corresponding sink 110. As is generally understood, while the sink 110 is being used, water and waste (e.g., food waste and other solid waste) may collect within the sink basin 108 and may be subsequently discharged therefrom via the drain 106. The water and waste flowing through the drain 106 may then be directed into the waste disposal 102 via a primary inlet 112 (as indicated by arrow 114), wherein the waste may be processed into fine particulates. The water and processed waste may then be discharged from the waste disposal 102 via a disposal outlet 116 (as indicated by arrow 118) into a suitable flow conduit or discharge line (not shown) of the associated plumbing.

Additionally, as shown in FIG. 1, in several embodiments, the waste disposal 102 may also be configured to receive water and/or waste discharged from a dishwasher 120 in fluid communication with the disposal 102 via a secondary inlet 122 (as indicated by arrow 124). In such embodiments, the waste received from the dishwasher 120 may similarly be processed into fine particulates and subsequently discharged from the waste disposal 102 (as indicated by arrow 118).

Figure 2:
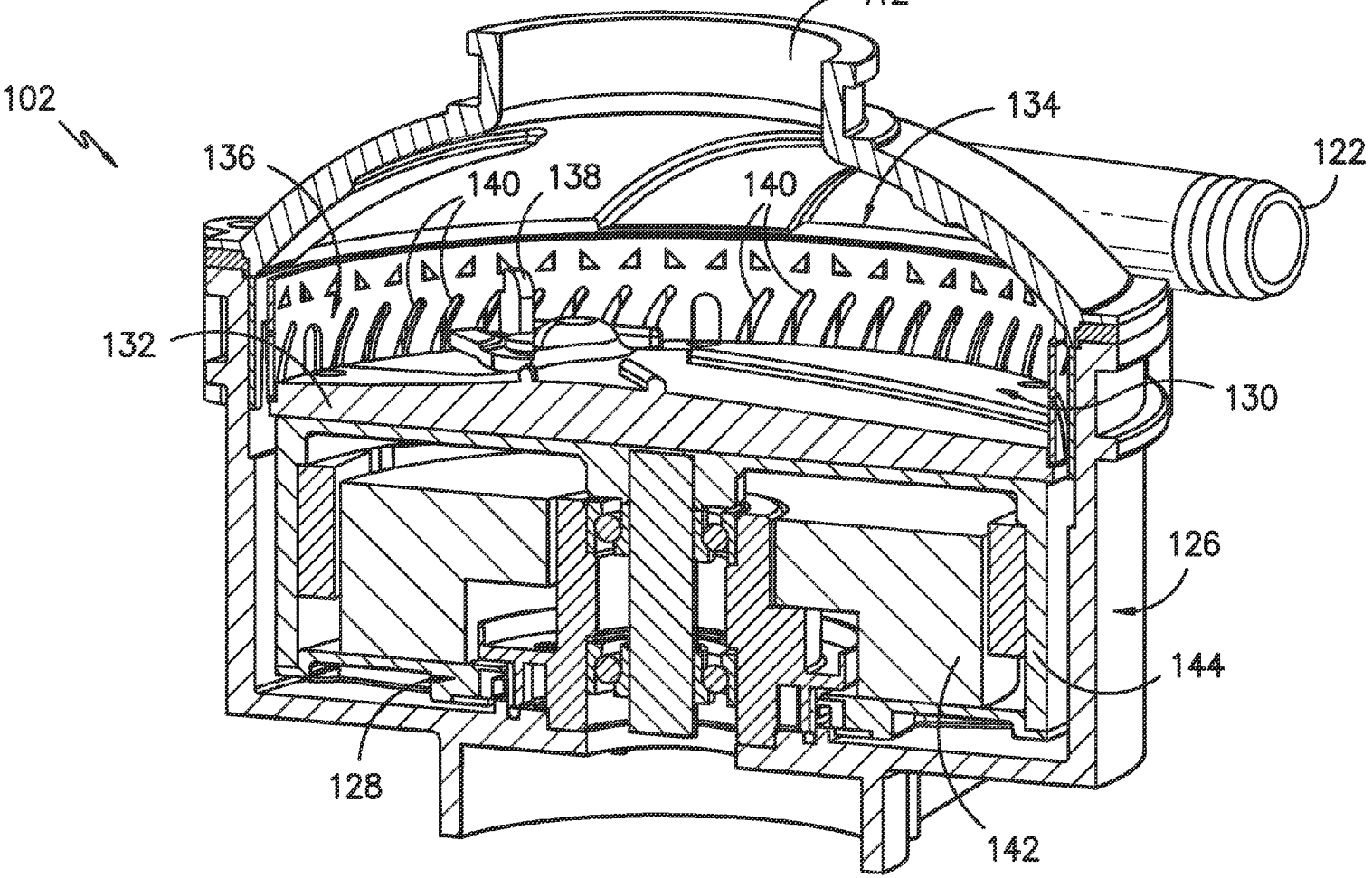
FIG. 2 illustrates a cross-sectional view of one embodiment of the waste disposal shown in FIG. 1.

Referring now to FIG. 2, a cross-sectional view of one embodiment of the waste disposal 102 of the system 100 shown in FIG. 1 is illustrated in accordance with aspects of the present subject matter. As particularly shown in FIG. 2, the waste disposal 102 generally includes a housing 126 configured to form an outer casing or enclosure for the various other components of the disposal 102. In general, the housing 126 may have any suitable configuration that allows it to function as a casing or enclosure for the disposal components. For instance, the housing 130 may be formed from two or more housing components configured to be coupled to one another so as to form a complete housing assembly, such as by forming the housing from a upper housing portion configured to be coupled to a lower housing portion.

Moreover, the housing 126 may define one or more inlets and outlets for receiving and discharging water and/or waste. For instance, as described above with reference to FIG. 1, a primary inlet 112 may be defined in the housing 126 (e.g., at the top of the housing 126) for receiving water/waste discharged from the sink 110 and a secondary inlet 122 may be defined in the housing 126 for receiving water and/or waste discharged from a dishwasher (e.g., dishwasher 120 of FIG. 1) in fluid communication with the disposal 102. In addition, a discharge outlet 116 may be defined in the housing 126 (e.g., at and/or adjacent to the bottom of the housing 126) for discharging water and processed waste from the disposal 102.

As shown in FIG. 2, the disposal may also include a motor 128 and a cutter system 130 disposed within the housing 126. As is generally understood, the motor 128 may be configured to rotate a cutter plate 132 of the cutter system 130 directly below a grind chamber 134 defined within the housing 126 between the cutter plate 132 and the primary inlet 112. Thus, as the cutter plate 132 is rotated, water/waste entering the grind chamber 134 via the primary inlet 112 may be directed radially outwardly along the plate 132 towards a stationary cutter ring 136 of the cutter system 130 disposed around the inner perimeter of the housing 126 (i.e., around the outer perimeter of the grind chamber 134). In addition, the cutter plate 132 may include a cutter lug 138 coupled thereto and/or extending therefrom for pushing waste flowing along the outer perimeter of the plate 132 into the adjacent cutter ring 136. As will be described below, the cutter ring 136 may, in turn, define a plurality of cutter slots 140 that serve to grind, shred, cut and/or otherwise process the waste. Accordingly, the waste flowing along the outer perimeter of the cutter plate 132 may be pushed by the cutter lug 138 into and/or against the cutter slots 140 of the stationary cutter ring 136 in order to process the waste into fine particulates. The processed waste may then be discharged from the disposal 102 via the discharge outlet 116.

It should be appreciated that the motor 128 and the cutter plate 132 of the disclosed disposal 102 may generally have any suitable configuration known in the art that allows such components to function as described herein. For instance, as shown in the illustrated embodiment, the motor 128 has an outrunner or external rotor configuration. As such, the motor 128 may include a stator 142 and a rotor 144 extending around the outer circumference of the stator 142. In such an embodiment, the cutter plate 132 may be formed integrally with the rotor 144, such as by forming the cutter plate 132 as all or a portion of the top wall of the rotor 144, or the cutter plate 132 may be coupled to the rotor 144 using any other suitable means, such as by using mechanical fasteners. In other embodiments, the motor 128 may have an internal rotor configuration and may include a shaft (not shown) extending outwardly therefrom. In such embodiments, the cuter plate 132 may be coupled to the motor shaft for rotation therewith.

It should also be appreciated that, in alternative embodiments, the waste disposal system 100 may include a waste disposal 102 having any other suitable configuration known in the art that allows for the processing of water and/or waste flowing from a sink, dishwasher and/or any other source using the disclosed cutter ring 136.

Figure 3:
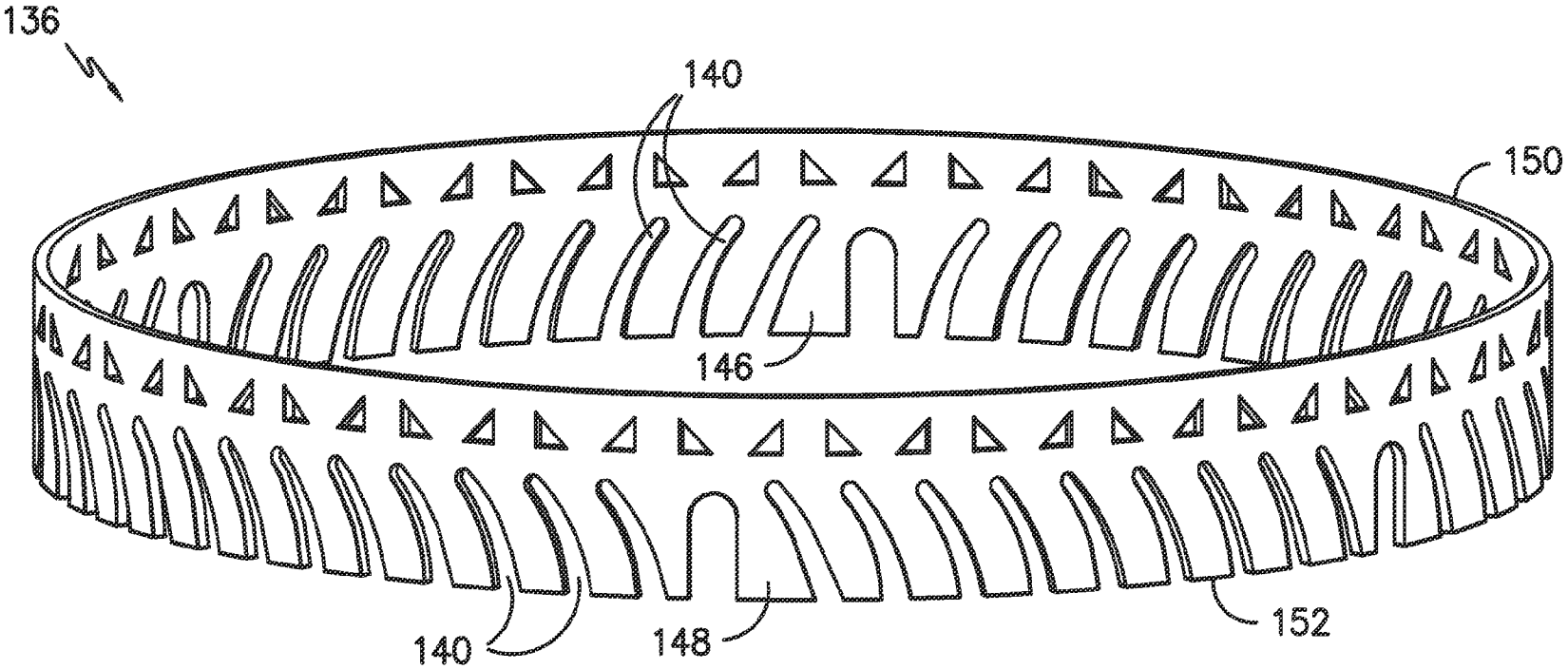
FIG. 3 illustrates a perspective view of one embodiment of a stationary cutter ring suitable for use within the waste disposal shown in FIGS. 1 and 2.
Figure 4:
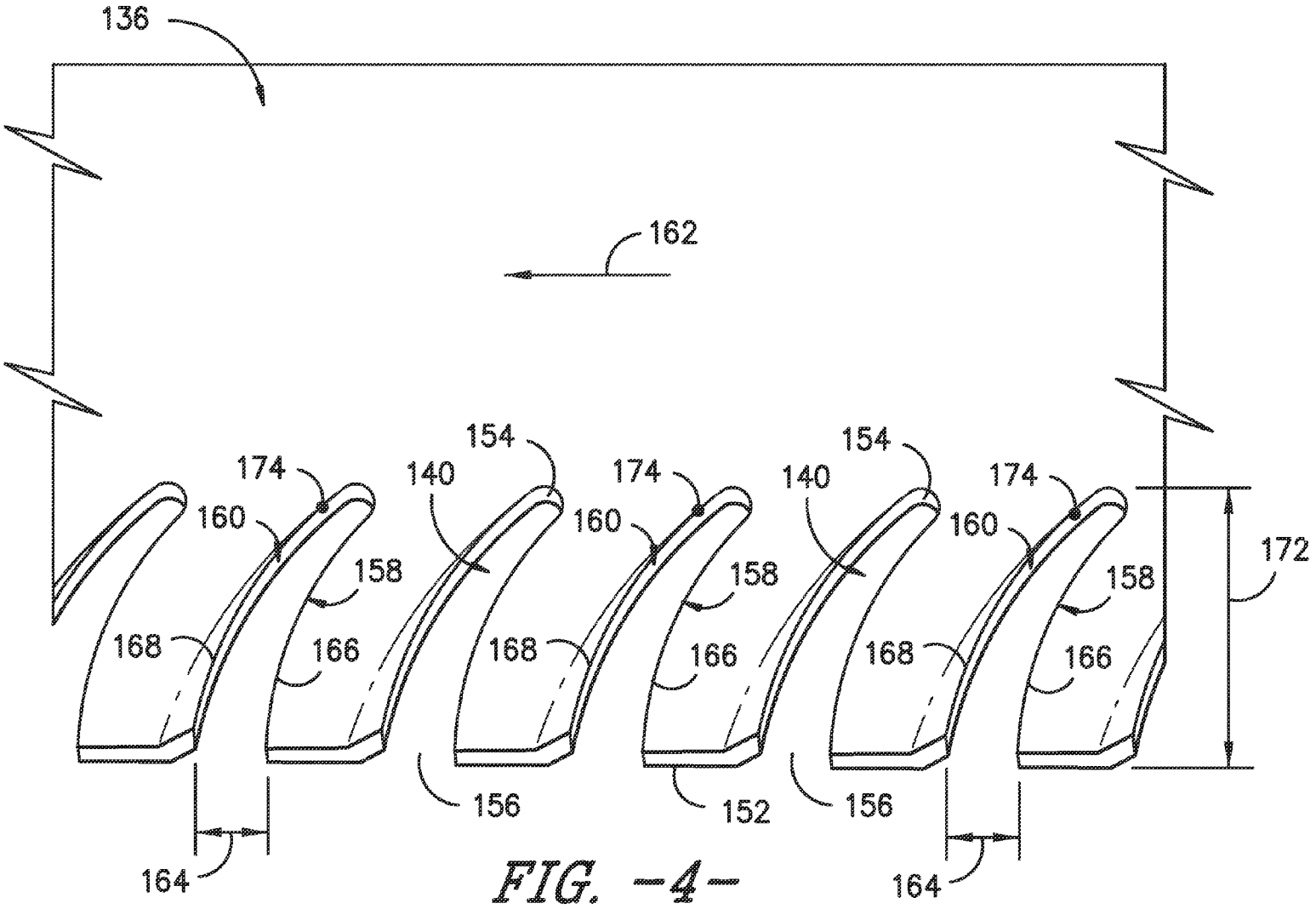
FIG. 4 illustrates a close-up view of a portion of the stationary cutter ring shown in FIG. 3, particularly illustrating a portion of the inner perimeter of the stationary cutter ring as viewed from the perspective of the center of the ring.
Figure 5:
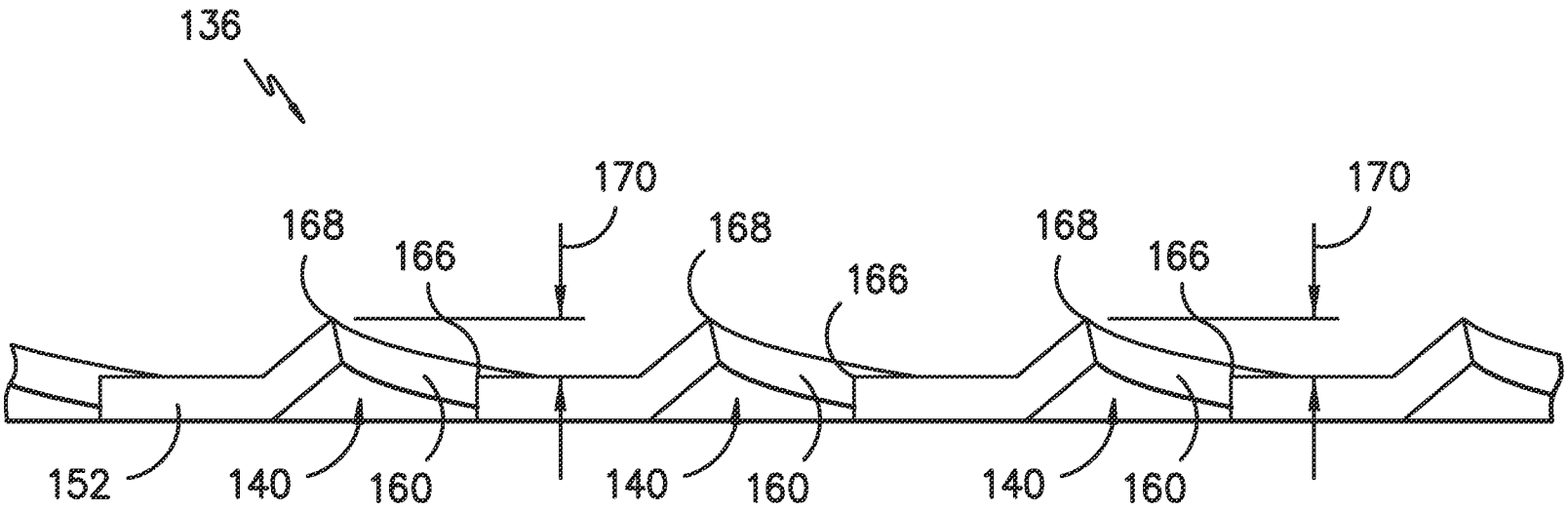
FIG. 5 illustrates a bottom view of a portion of the cutter ring shown in FIG. 4, particularly illustrating an example of radially staggered edges that may be defined along each side of the cutter slots defined in the cutter ring.

Referring now to FIGS. 3-5, one embodiment of the cutter ring 136 described above is illustrated in accordance with aspects of the present subject matter. Specifically, FIG. 3 illustrates a perspective view of the cutter ring 136 and FIG. 4 illustrates a partial view of the cutter ring 136 shown in FIG. 3 from the perspective of looking radially outwardly from the center of the ring 135. Additionally, FIG. 5 illustrates a partial, bottom view of the cutter ring 136 shown in FIG. 3.

As shown, the cutter ring 136 generally includes an inner surface 146 and an outer surface 148 extending circumferentially around the inner and outer perimeters, respectively, of the cutter ring 136 so as to form a complete ring. The inner and outer surfaces 146, 148 also extend axially between an upper surface 150 and a lower surface 152 of the cutter ring 136.

Additionally, as indicated above, the cutter ring 136 may also include a plurality of cutter slots 140 defined through the ring 136 so as to extend radially between the inner and outer surfaces 146, 148. As particularly shown in FIG. 4, each cutter slot 140 may include a top end 154 and a bottom end 156 and may be configured to define a curved profile extending between the top and bottom ends 154, 156 such that each cutter slot 140 extends both axially and circumferentially between the upper and lower surfaces 150, 152 of the cutter ring 136. For example, in several embodiments, each cutter slot 140 may be defined lengthwise by a first or forward curved sidewall 158 and a second or rear curved sidewall 160 extending both axially and circumferentially from the bottom end 156 to the top end 154 of the slot 140. As such, the sidewalls 158, 160 may be configured to define curved surfaces along both sides of each cutter slot 140 such that the cutter slots 140 generally define continuously curved profiles between their top and bottom ends 154, 156.

In several embodiments, the curvature of the cutter slots 140 may be selected such that each slot 140 is curved forward relative to the rotational direction of the cutter plate 132 (indicted by arrow 162 in FIG. 4). Thus, the top end 154 of each cutter slot 140 may be located forward of the bottom end 156 such that the cutter lug 138 passes by the top end 154 of each slot 140 first as the cutter plate 132 is rotated about the rotational axis of the motor 128. Such forwardly curved cutter slots 140 may allow for a reduction in the force applied at the top portion of the rotating cutter lug 138. Specifically, the forwardly curved profile may allow for the creation of a varied cutting force distribution along the axial height of the cutter lug 138 that tends to reduce the moment acting on the lug 138, thereby reducing the potential for component damage. Moreover, the forwardly curved profiles of the cutter slots 140 may also assist in facilitating the initiation of slicing and/or shredding of the waste being processed, which may further reduce the overall loads being applied through the rotating cutter lug 138.

It should be appreciated by those of ordinary skill in the art that the curved cutter slots 140 disclosed herein may allow for enhanced load reduction as compared to cutter rings including straight-walled, angled cutter slots. Specifically, while such straight-walled, angled cutter slots may provide for some reduction in the required cutting loads (e.g., as compared to axially extending cutter slots), such angled cutter slots result in a uniform force distribution along the axial height of the cutter lug and, thus, do not significantly impact the moment on the cutter lug. In contrast, the disclosed curved cutter slots 140 create a varied force distribution that provides for lower loads to be applied at the top of the cutter lug 138, thereby allowing for the moment acting on the lug 138 to be reduced significantly.

Additionally, as shown in FIG. 4, each cutter slot 140 may define a circumferential width 164 extending between its forward and rear curved sidewalls 158, 160. In several embodiments, the cutter slots 140 may be configured such that the width 164 is tapered or is otherwise reduced as each slot 140 extends lengthwise from its bottom end 156 to its top end 154. For example, in a particular embodiment, the width 164 of each slot 140 at its top end 154 may range from about 20% less to about 80% less than the width 164 of each slot 140 at its bottom end 156. Such a tapered or narrowing slot width may generally be selected so as to mimic the food distribution within the grind chamber 134. Specifically, during operation of the waste disposal 102, a larger amount of waste is typically located adjacent to the bottom surface of the cutter ring 136 (e.g., the waste being pushed radially outwardly along the top surface of the cutter plate 132). As such, the larger slot width 164 at the bottom end 156 of each cutter slot 140 may be designed to accommodate the larger amount of processed waste that passes therethrough.

It should be appreciated that, given the reduced loading provided by the curved cutter slots 140, the maximum width 164 of the slots 140 may be reduced significantly. As a result, a larger number of cutter slots 140 may be defined around the circumference of the cutter ring 136, thereby allowing for a reduction in the required cutting time and leading to an overall improvement in grind performance.

As shown in FIGS. 4 and 5, each of the curved sidewalls 158, 160 may generally define a radially inner edge. For example, the forward sidewall 158 may define a forward inner edge 166 and the rear sidewall 160 may define a rear inner edge 168. In several embodiments, the inner edges 166, 168 of the curved sidewalls 158, 160 may be configured to be radially staggered relative to one another. For example, as particularly shown in FIGS. 4 and 5, a portion of the cutter ring 136 adjacent to the rear sidewall 160 of each cutter slot 140 may be bent or angled upwards such that the rear inner edge 168 extends radially inwardly relative to the forward inner edge 166 by a given radial distance 170. Such a radially staggered configuration may allow for the rear edge 166 of each cutter slot 140 to serve as the cutting edge and may ensure that the waste to be processed contacts the rear edge 16 of each slot 140 at the cutter lug 138 pushes the waste radially outwardly against the cutter ring 136. In addition, the raised rear edges 148 may assist in directing the waste into each cutter slot 140, which may allow for an overall reduction in the circumferential width 164 of each cutter slot 140.

It should be appreciated that the radial distance 170 across which the inner edges 166, 168 are staggered may generally correspond to any suitable distance. However, in several embodiments, the rear inner edge 168 may be positioned radially inwardly relative to the forward inner edge 166 by a radial distance 170 ranging from about 0.020 inches to about 0.060 inches, such as from about 0.025 inches to about 0.050 inches or from about 0.030 inches to about 0.040 inches.

It should also be appreciated that, in one embodiment, the inner edges 166, 168 may only be configured to be radially staggered along a portion of an axial height 172 defined between the top and bottom ends 154, 156 of each cutter slot 140. For example, as shown in FIG. 4, the rear inner edge 168 may only be configured to extend radially inwardly relative to the forward inner edge 166 from the bottom end 156 of each cutter slot 140 to a given reference location (e.g., indicated at point 174 in FIG. 4). In such an embodiment, the radial distance 170 across which the inner edges 166, 168 are staggered may be tapered or reduced as each cutter slot 140 extends from its bottom end 156 to the reference location 174.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A cutter for a waste disposal, the cutter comprising:

a cutter ring including an upper surface and a lower surface, the cutter ring defining a plurality of cutter slots, each cutter slot extending between a top end and a bottom end and being defined by a first curved sidewall and a second curved sidewall, wherein the first and second curved sidewalls extend between the top and bottom ends such that each cutter slot defines a curved profile extending axially and circumferentially between the upper and lower surfaces of the cutter ring.

2. The cutter of claim 1, wherein each cutter slot is forwardly curved such that the top end is positioned forward of the bottom end relative to a rotational direction of a rotating cutter plate of the waste disposal.

3. The cutter of claim 1, wherein the first curved sidewall of each cutter slot defines a first inner edge and the second curved sidewall of each cutter slot defines a second inner edge, the first inner edge being staggered radially relative to the second inner edge along at least a portion of an axial height defined between the top and bottom ends.

4. The cutter of claim 3, wherein the first and second inner edges are staggered radially such that the second inner edge is positioned radially inwardly relative to the first inner edge by a radial distance.

5. The cutter of claim 4, wherein the radial distance ranges from about 0.020 inches to about 0.060 inches.

6. The cutter of claim 4, wherein the first inner edge is positioned forward of the second inner edge relative to a rotational direction of a rotating cutter plate of the waste disposal.

7. The cuter of claim 1, wherein a width of each cutter slot is reduced from the bottom end to the top end.

8. The cutter of claim 7, wherein the width of each cutter slot is reduced about 20% to about 80% as the cutter slot extends lengthwise from the bottom end to the top end.

9. A cutter for a waste disposal, the cutter comprising:

a cutter ring including an upper surface and a lower surface, the cutter ring defining a plurality of cutter slots, each cutter slot extending between a top end and a bottom end and being defined by first and second sidewalls extending between the top and bottom ends, the first sidewall defining a first radially inner edge and the second sidewall defining a second radially inner edge, wherein the first radidly inner edge is staggered radially inwardly relative to the second radially inner edge along at least a portion of an axial height defined between the top and bottom ends.

10. The cutter of claim 9, wherein the first and second sidewalls are curved between the top and bottom ends such that each cutter slot defines a curved profile extending axially and circumferentially between the upper and lower surfaces of the cutter ring.

11. The cutter of claim 9, wherein the first and second radially inner edges are staggered radially inwardly such that the second radially inner edge is positioned radially inwardly relative to the first radially inner edge by a radial distance.

12. The cutter of claim 11, wherein the radial distance ranges from about 0.020 inches to about 0.060 inches.

13. The cutter of claim 11, wherein the first radially inner edge is positioned forward of the second radially inner edge relative to a rotational direction of a rotating cutter plate of the waste disposal.

14. The cutter of claim 9, wherein a width of each cutter slot is reduced from the bottom end to the top end.

15. The cutter of claim 14, wherein the width of each cutter slot is reduced about 20% to about 80% as the cutter slot extends lengthwise from the bottom end to the top end.

16. A waste disposal, comprising:

a housing;

a motor disposed within the housing; and a cutter system disposed within the housing, the cutter system comprising:

a cutter plate rotatably coupled to the motor, the cutter plate including a cutter lug positioned adjacent to an outer perimeter of the cutter plate; and a cutter ring extending around the outer perimeter of the cutter plate, the cutter ring including an upper surface and a lower surface, the cutter ring defining a plurality of cutter slots, each cutter slot extending between a top end and a bottom end and being defined by a first curved sidewall and a second curved sidewall, wherein the first and second curved sidewalls extend between the top and bottom ends such that each cutter slot defines a curved profile extending axially and circumferentially between the upper and lower surfaces of the cutter ring.

17. The waste disposal of claim 16, wherein each cutter slot is forwardly curved such that the top end is positioned forward of the bottom end relative to a rotational direction of the cutter plate.

18. The waste disposal of claim 16, wherein the first curved sidewall of each cutter slot defines a first inner edge and the second curved sidewall of each cutter slot defines a second inner edge, the first inner edge being staggered radially relative to the second inner edge along at least a portion of an axial height defined between the top and bottom ends such that the second inner edge is positioned radially inwardly relative to the first inner edge by a radial distance.

19. The waste disposal of claim 18, wherein the first inner edge is positioned forward of the second inner edge relative to a rotational direction of a rotating cutter plate of the cutter system.

20. The waste disposal of claim 16, wherein a width of each cutter slot is reduced from the bottom end to the top end.

* * * * *